US006095307A

United States Patent [19]

Hamulak et al.

[11] Patent Number: 6,095,307

[45] Date of Patent: Aug. 1, 2000

[54] METHOD AND APPARATUS FOR DETECTING PRESS TOOL FAILURE

[75] Inventors: Michael A. Hamulak, Brooklyn; Randy Monahan, Strongsville; Christopher P. Rose, Brecksville; Robert D. Pritchard, Westlake, all of Ohio

[73] Assignee: A. J. Rose Manufacturing Co., Avon, Ohio

[21] Appl. No.: 09/262,476

[22] Filed: Mar. 4, 1999

[51] Int. Cl.[7] ..... B30B 1/26; B30B 15/14

[52] U.S. Cl. ..... 192/129 B; 100/53; 100/99

[58] Field of Search ..... 192/129 B; 100/53, 100/99; 72/453.13

[56] References Cited

U.S. PATENT DOCUMENTS

| | | | |
|---|---|---|---|
| Re. 30,298 | 6/1980 | Keller . | |
| 1,618,001 | 2/1927 | Gauthier . | |
| 2,737,224 | 3/1956 | Jones . | |
| 2,737,916 | 3/1956 | Thompson . | |
| 2,821,907 | 2/1958 | Stone . | |
| 3,411,345 | 11/1968 | Wintriss . | |
| 3,444,390 | 5/1969 | Breidenback et al. . | |
| 3,446,063 | 5/1969 | Wintriss . | |
| 3,527,073 | 9/1970 | Wintriss . | |
| 3,555,865 | 1/1971 | Sebastian . | |
| 3,930,248 | 12/1975 | Keller . | |
| 4,023,044 | 5/1977 | Miller et al. . | |
| 4,195,563 | 4/1980 | Budraitis et al. . | |
| 4,351,233 | 9/1982 | Leonard | 100/53 X |
| 4,388,860 | 6/1983 | Thies . | |
| 4,423,674 | 1/1984 | Thies . | |
| 4,580,965 | 4/1986 | Wernecke | 192/129 B X |
| 4,593,547 | 6/1986 | Heiberger . | |
| 4,633,720 | 1/1987 | Dybel et al. . | |
| 4,651,273 | 3/1987 | Braitinger et al. . | |
| 4,698,991 | 10/1987 | Kirii et al. . | |
| 4,744,036 | 5/1988 | Van Tiggelen . | |
| 4,750,131 | 6/1988 | Martinez . | |
| 4,869,659 | 9/1989 | Sakai et al. . | |
| 4,918,616 | 4/1990 | Yoshimura et al. . | |
| 4,936,126 | 6/1990 | Sato . | |
| 4,945,742 | 8/1990 | Schoch | 72/453.13 X |
| 4,951,537 | 8/1990 | Bennett | 72/453.13 X |
| 4,987,528 | 1/1991 | O'Brien . | |
| 5,007,817 | 4/1991 | Wallis . | |
| 5,125,332 | 6/1992 | Beck et al. . | |
| 5,361,615 | 11/1994 | Kirii et al. . | |
| 5,379,688 | 1/1995 | Ishii . | |
| 5,491,647 | 2/1996 | O'Brien et al. . | |
| 5,496,433 | 3/1996 | Miyashita et al. . | |
| 5,517,910 | 5/1996 | Skahan . | |
| 5,528,918 | 6/1996 | Kirii . | |
| 5,537,919 | 7/1996 | Bielfeldt et al. . | |
| 5,673,601 | 10/1997 | Ejima et al. . | |
| 5,699,729 | 12/1997 | Moschel . | |

*Primary Examiner*—Rodney H. Bonck
*Attorney, Agent, or Firm*—Pearne, Gordon, McCoy & Granger LLP

[57] ABSTRACT

A tool support and monitoring assembly for a press. The tool includes upper and lower die shoes, back-up plates, and upper and lower die tooling. The die tooling is secured to the back-up plate and includes a first surface facing the back-up plate and an opposite second surface. The back-up plate defines an air plenum which is connected to a pressure monitoring device. The die tooling defines a plurality of small bores which communicate with the air plenum. The bores extend from the first surface toward the second surface of the die tooling. The pressure monitoring device detects air pressure in the air plenum and bores, and shuts down the press to prevent a subsequent stroke when a pressure drop indicative of tool failure is detected.

13 Claims, 4 Drawing Sheets

METHOD AND APPARATUS FOR DETECTING PRESS TOOL FAILURE

BACKGROUND OF THE INVENTION

The present invention is directed toward a method and apparatus for monitoring a tool in a press. It is important to monitor the condition of a tool to determine when the tool has failed, and to prevent a subsequent press stroke which can lead to catastrophic failure. Unfortunately, monitoring the condition of the tool is not easy due to the harsh operating environment. Several methods of monitoring tools have been proposed, each having its own drawbacks.

U.S. Pat. No. 3,444,390 discloses a press impact sensor which is mounted to a platen beneath a lower die. The sensor is a piezo-electric sensor which converts pressure or shock waves into electrical signals. The sensed signals are compared to a reference signal and, when the signals fall outside a predetermined normal range, the press is shut down to prevent a subsequent strike. U.S. Pat. Nos. 3,930,248 and Re. 30,298 disclose a similar piezo-electric control circuit. U.S. Pat. No. 4,023,044 discloses a similar pressure monitoring arrangement for a punch press.

U.S. Pat. Nos. 4,936,126; 4,987,528; 4,918,616; 4,750,131; 4,698,991; 4,651,273; 4,633,720; and 4,593,547 disclose methods for sensing die pressure and defective parts.

U.S. Pat. No. 3,555,865 discloses a press having an upper die, a lower die, a fixed anvil or platen, and a sow block disposed between the lower die and the fixed platen. The platen has a series of passageways formed therein through which hydraulic fluid flows to an area between the sow block and the platen to form a cushioning film therebetween.

There exists a need in the art for a simple and reliable method and apparatus for sensing failure of a tool in a press. There also exists a need in the art for a method for controlling a press to prevent a subsequent stroke in the event of tool failure.

SUMMARY OF THE INVENTION

The present invention is directed toward a simple and reliable apparatus and method for monitoring a press tool for failure. The present invention is further directed toward a method for controlling a press to prevent a subsequent stroke upon detection of tool failure.

In accordance with the present invention, a tool includes upper and lower die shoes, a plurality of back-up plates secured to the die shoes, and die tooling secured to the back-up plates by one or more attachment bolts. The back-up plate has a plurality of annular grooves formed on a surface thereof which faces the die tooling. At least one of the grooves receives a seal to define a space between the at least one groove, the back-up plate, and the tool. An air plenum is in communication with the space. A bore extends through the back-up plate and serves as an air inlet through which pressurized air is introduced into the air plenum.

In further accordance with the present invention, the die tooling has a plurality of air passages formed therein which extend from the surface of the die tooling facing the back-up plate toward an opposite surface of the die tooling. The air passages are aligned with the air plenum, and are supplied with pressurized air therefrom.

In further accordance with the present invention, the air inlet of the back-up plates are fluidly connected to each other by an air line. The air line has a pressure transducer therein which communicates pressure signals to a pressure monitoring device. When the tool fails pressurized air is released from the air passages and/or the air plenum. The drop in air pressure is detected by the pressure monitoring device. The pressure monitoring device continuously monitors the air pressure signal and sends signals to the press control device when the sensed pressure exceeds reference limit(s). When the sensed pressure exceeds the limit(s), the press control device shuts down the stamping press to prevent a subsequent stroke which may result in catastrophic failure.

BRIEF DESCRIPTION OF THE DRAWINGS

These And further features of the present invention will be a apparent with reference to the following description and drawings, wherein.

DETAILED DESCRIPTION OF THE PREFERRED EMBODIMENT

Figure 1:
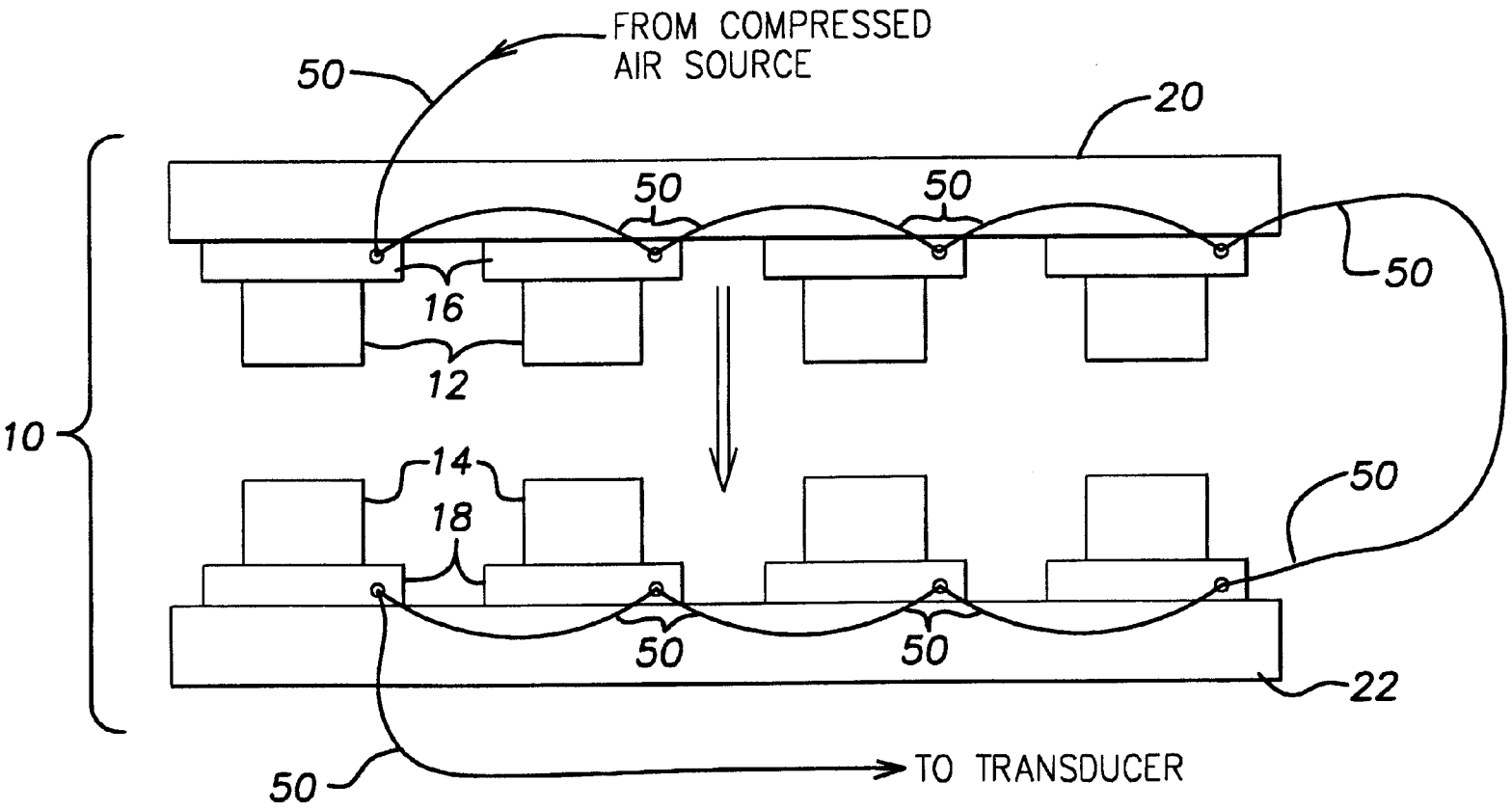
FIG. 1 is a schematic representation of a tool according to the present invention.

It should be noted that in the detailed description which follows, identical components have the same reference numeral, regardless of whether they are shown in different embodiments of the present invention. It should also be noted that, in order to clearly and concisely disclose the present invention, the drawings may not necessarily be to scale and certain features of the invention may be shown in somewhat schematic form.

With reference to FIG. 1, a press tool 10 according to the present invention is illustrated. The press tool 10, which is a removable assembly inserted into a stamping press (not shown), includes upper and lower die tooling 12, 14, back-up plates 16, 18, and upper and lower die shoes 20, 22. The upper die or upper die tooling 12 may also be referred to hereinafter as the movable or first dies and the lower die or lower die tooling 14 may be referred to hereinafter as the fixed or second dies.

Each upper die 12 is secured to an associated upper back-up plate 16, and each lower die 14 is secured to an associated lower back-up plate 18, as illustrated. The upper back-up plates 16 are secured to the upper die shoe 20, and the lower back-up plates are secured to the lower die shoe 22.

The upper die shoe 20 is secured to a ram (not shown). The lower die shoe 22 is secured to a fixed support or bolster (not shown). The ram is reciprocally movable between a first, upper position (FIG. 1) and a second, lower position. When the ram is in the first, upper position, the upper dies 12 are upwardly spaced from the lower dies 14. When the ram is in the second, lower position, the upper dies 12 are in contact with the lower dies 14. The upper position corresponds to zero degrees of crankshaft rotation or top dead center, and the lower position corresponds to 180 degrees of crankshaft rotation or bottom dead center.

Generally, a piece of metal to be formed is placed between associated ones of the upper and lower dies 12, 14 when the ram is in the upper position. As the ram is moved into the lower position, the piece of metal is deformed between the upper and lower dies 12, 14. After the ram is moved upwardly away from the lower position, the deformed metal is removed from the lower die 14. In a sequential press having plural stations, a transfer mechanism (not shown) may move the deformed metal to an adjacent set of upper and lower dies for further forming. It is submitted that the stamping press and method described hereinbefore is conventional and well known in the art.

The following overview of the press control system according to the present invention is provided. In the present invention an air line 50 connects the upper and lower back-up plates 16, 18 to a pressure transducer. The pressure transducer transmits an analog signal corresponding to the sensed pressure to a pressure monitoring device. The pressure monitoring device includes a converter, to convert the analog pressure signal into a digital signal, and a software program, to interpret the digital signal.

If the sensed pressure is within predetermined acceptable parameters, the pressure monitoring device sends a signal to the press control device indicative of same. However, if the sensed pressure is outside the predetermined acceptable parameters, and thereby indicates that the tool has failed, the pressure monitoring device transmits a signal to the press control device indicating that the press should be stopped. The press control device controls starting and stopping of the press in response to the signals provided to it, such as the signal from the pressure monitoring device. Although monitoring of the tool condition is described hereinafter relative to the lower die tooling 14, it is considered apparent that the description is equally applicable to the upper die tooling 12.

The back-up plate 18 may be universal in design or may be custom made to correspond with the configuration of the associated lower die tooling 14. Due to the large variation in tool configurations, custom made back-up plates are routinely required. Accordingly, it is to be understood that in the description to follow, the lower die tooling 14 and back-up plate 18 are presented in schematic form to illustrate the preferred embodiment of the present invention, and the present invention is not limited to the specific appearance or configuration of the die tooling/back-up plate specifically illustrated herein.

Figure 3:
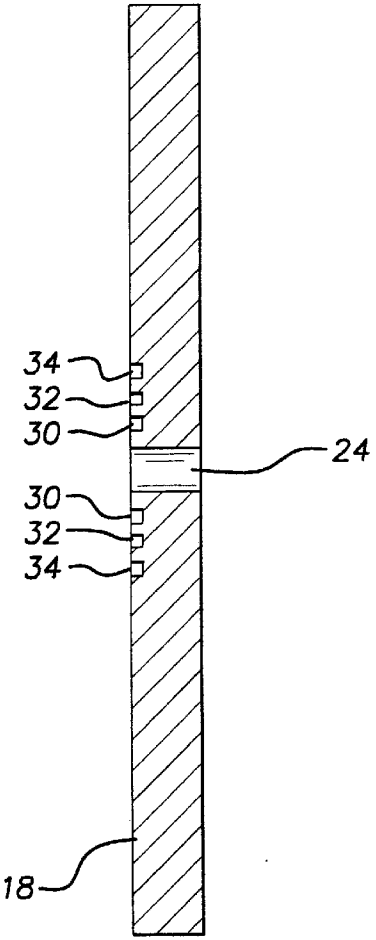
FIG. 3 is a cross-sectional view of the back-up plate as see along line III—III of FIG. 2.
Figure 2:
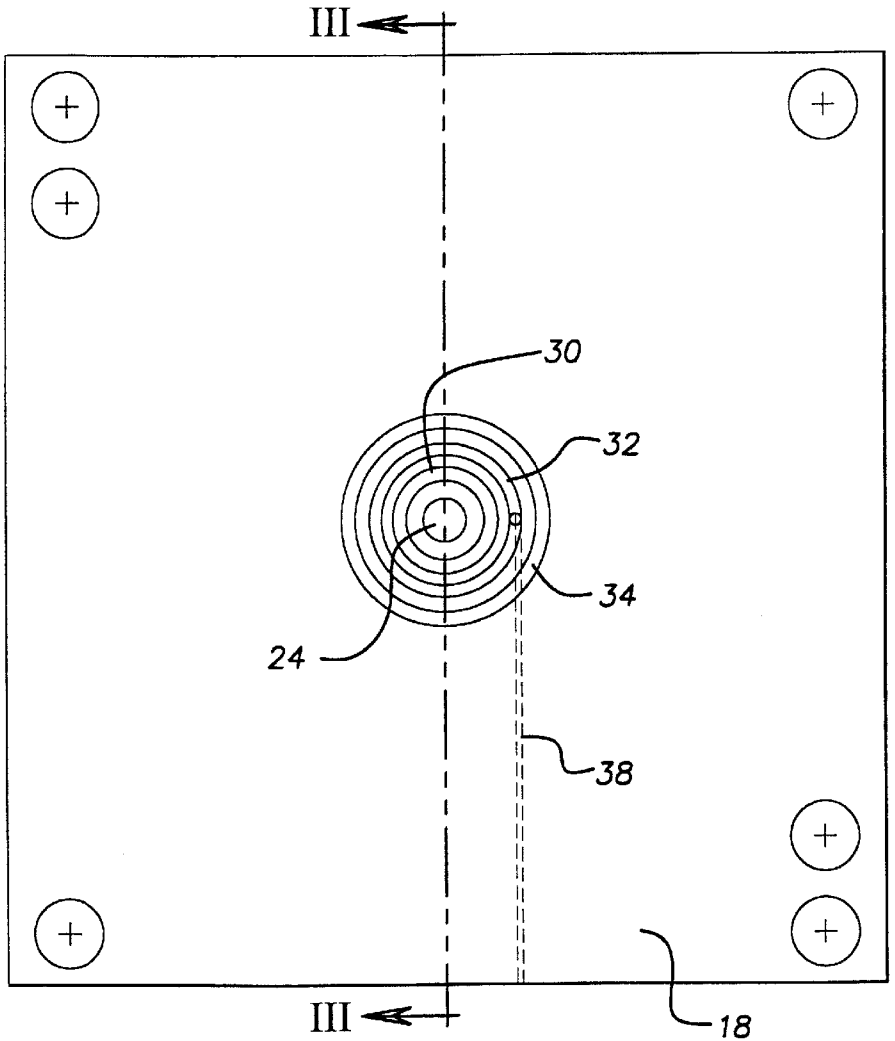
FIG. 2 is a top plan view of a back-up plate according to the present invention.
Figure 4:
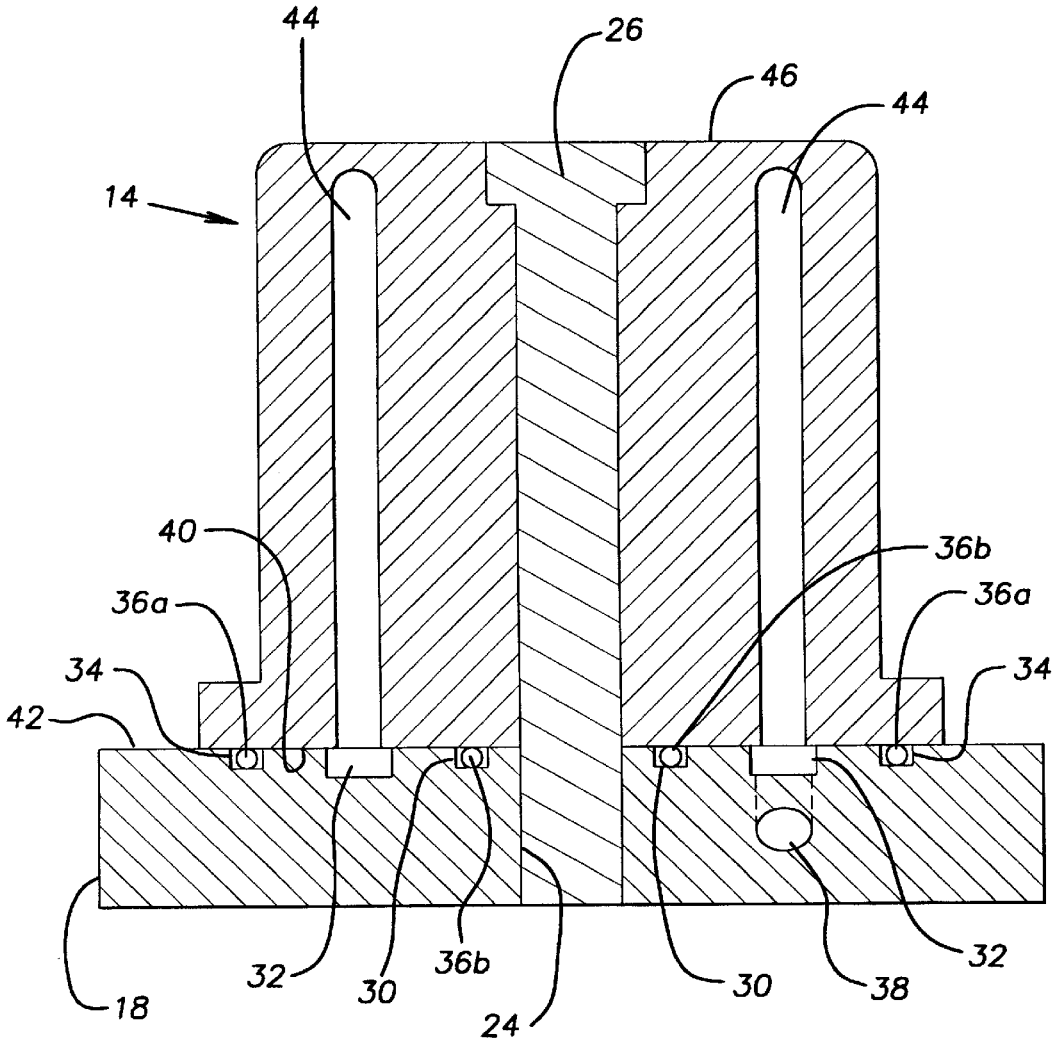
FIG. 4 is a cross-sectional view of the back-up plate and die tooling according to the present invention.

With reference to FIGS. 2–4, the illustrated and preferred back-up plate 18 includes a threaded central bore 24 which receives an attachment bolt 26 to releasably secure the die tooling 14 thereto. The back-up plate 18 is, in turn, releasably secured to the lower die shoe 22 by mechanical fasteners.

Radially surrounding the central bore are three annular grooves 30, 32, 34. The radially inner and outer grooves 30, 34 are adapted to receive O-rings 36*a*, 36*b* to seal the die tooling 14 to the back-up plate 18. The intermediate groove 32 serves as an air plenum, and may be wider or otherwise have a greater volume than the inner and outer grooves 30, 34, as necessary to provide the desired capacity and pressure characteristics.

A bore 38 extends through the back-up plate 18 and communicates with the intermediate groove 32. The bore 38 serves as an air inlet through which pressurized air is introduced into the air plenum or intermediate groove 32.

The die tooling 14 has a first, generally planar surface 40 facing the grooved surface 42 of the back-up plate 18. The O-rings 36*a*, 36*b* seal the area defined between the O-rings, the first surface 40 of the die tooling 14, and the back-up plate 18.

The die tooling 14 has a plurality of small bores 44 extending from the first surface 40 toward the opposite, second surface 46. The bores 44 align and fluidly communicate with the air plenum or intermediate groove 32 and the bore 38. Experimentation has found that three small bores positioned 120 degrees apart performs satisfactorily. Naturally, more or less than three bores may also be employed without departing from the scope and spirit of the present invention.

The small bores 44 stop a short distance below the second surface 46. The distance is chosen so as to be as close to the second surface 46 as possible without weakening the die tooling. It is noted that the second surface 46 of the die tooling 14 is engaged by the metal being formed, and is most likely to fracture.

When multiple die tooling is accommodated in a single tool, such as the tool 10 shown in FIG. 1, the air inlets 38 of each of the back-up plates 16, 18 are connected together by means of air lines or conduits 50 in a daisy-chain type fashion. As such, the back-up plates 16, 18 and upper and lower die tooling 12, 14 are fluidly interconnected in a serial fashion and define a pressurized system.

The system is continuously provided with pressurized air from a compressed air source, preferably at a low pressure of between about 20–30 psi, and then monitored in the fashion described hereinafter to determine when one of the die tooling 12, 14 fails. The supplied pressure counteracts unavoidable small system leaks, and establishes a constant set point or reference level.

A pressure transducer is provided in the air line downstream of the die tooling 12, 14, and senses the air pressure in the system. The transducer provides an analog electrical signal corresponding to the sensed air pressure to a pressure monitoring device. As used herein, the pressure monitoring device includes a signal conditioning device and a software control program. The output from the pressure monitoring device is supplied to the press control device. The press control device is operable to start and stop the press in response to signals which it receives, including signals from the pressure monitoring device.

The signal conditioning device, such as a signal conditioning board, converts the analog pressure signal into a digital pressure signal. The computer software program interprets the digital pressure signal and sends control signals to the control device to operate the press in accordance with the sensed pressure. One software control program used satisfactorily by applicants is sold under the tradename SAMVIEW by Signature Technologies, Inc., of Dallas, Tex.

The signal conditioning device receives numerous other signals from sensors in the press monitoring system, and these signals are converted and supplied to the press control device. Typically, these sensed parameters are correlated to the angular position of the crank shaft to provide a reference point for analysis.

During the 360 degrees of crank shaft rotation, the die tooling 12, 14 engage and deform metal for only a fraction of the time. During this active portion or working stroke, which is typically only the portion of the stroke before and after bottom dead center, or between about 120 and 240 degrees of crank shaft rotation, the upper die tooling strikes and deforms the metal and then moves away from the formed piece of metal.

Figure 5:
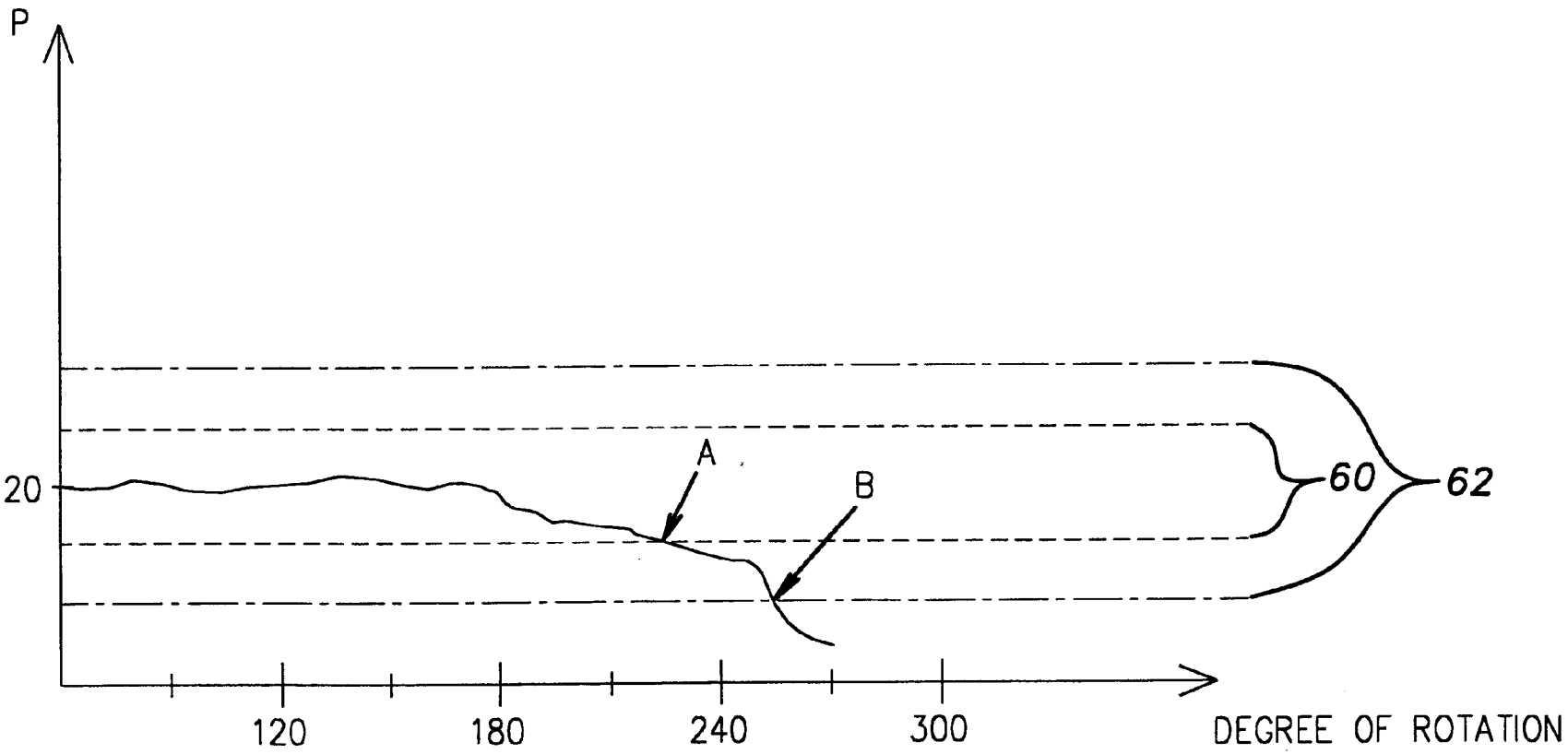
FIG. 5 is a graph illustrating operation of a control system according to the present invention.

With reference to FIG. 5, a function of the software program provided by the pressure monitoring device is to monitor the sensed pressure relative to a set point pressure and, if there is a substantial change, prevent a subsequent press stroke. Preferably, there are inner and outer limits 60, 62 above and below the set point pressure. Typically, the sensed pressure varies slightly during a cycle, but will stay within the inner limits 60. If the sensed pressure passes the inner limits 60 as indicated by arrow A, it is indicative of some problem, and the pressure monitoring device will send a signal to the press control device to shut down the press at top dead center or zero degrees rotation. If the pressure passes through the outer limits 62 as indicated by arrow B, indicative of a serious failure in the pressurized system, the pressure monitoring device will send a signal to the press control device to shut down the press immediately.

While the preferred embodiment of the present invention is shown and described herein, it is to be understood that the same is not so limited but shall cover and include any and all modifications thereof which fall within the purview of the invention. For example, if the die tooling does not have a central attachment bolt, only one outer seal will be necessary to seal the space between the die tooling and the back-up plate. Also, the seals and grooves are not limited to being circular in shape. It is also contemplated that the seals could be unnecessary if a satisfactory metal-to-metal sealing contact could be reliably provided.

What is claimed is:

1. A press apparatus, comprising:

a ram movable between a upper position and a lower position;

an upper die tooling movable with said ram;

a lower die tooling engageable with said upper die tooling when said ram is in said lower position and spaced from said upper die tooling a predetermined distance when said ram is in said upper position, said lower die tooling having a first surface facing away from said upper die tooling and a second surface facing toward said upper die tooling;

a back-up plate for supporting the lower die tooling, said back-up plate having a first surface to which the lower die tooling is affixed, said first surface defining an air plenum;

means for introducing pressurized air into said air plenum;

means for sensing a pressure of said pressurized air;

means for monitoring said sensed pressure; and, means for controlling said press in response to said sensed pressure.

2. A press apparatus according to claim 1, wherein said lower die tooling has a plurality of bores formed therein, said bores extending from said first surface toward said second surface of said lower die tooling and communicating with said air plenum.

3. A press apparatus according to claim 2, wherein said upper die tooling has a second surface facing toward said lower die tooling and an oppositely-directed first surface, said upper die tooling being secured to said ram via an upper back-up plate, said upper back-up plate having a first surface facing said upper die tooling first surface and to which the upper die tooling is affixed, said first surface defining an additional air plenum.

4. A press apparatus according to claim 3, wherein said upper die tooling has a plurality of bores formed therein, said bores extending from said first surface toward said second surface of said upper die tooling and communicating with said additional air plenum.

5. A press apparatus according to claim 1, wherein said upper die tooling has a second surface facing toward said lower die tooling and an oppositely-directed first surface, said upper die tooling being secured to an upper back-up plate, said upper back-up plate having a first surface facing said upper die tooling first surface and to which the upper die tooling is affixed, said first surface defining an additional air plenum.

6. A press apparatus according to claim 5, wherein said upper die tooling has a plurality of bores formed therein, said upper die tooling bores extending from said first surface toward said second surface of said upper die tooling and communicating with said additional air plenum.

7. A press apparatus according to claim 5, wherein there are a plurality of upper and lower die toolings, and wherein said air plenums are fluidly interconnected.

8. A press apparatus according to claim 1, wherein there are a plurality of upper and lower die toolings, and wherein said air plenums are fluidly interconnected.

9. A die tooling assembly, comprising:

a back-up plate having a surface in which an air plenum is formed, said air plenum being in fluid communication with an air inlet formed in said back-up plate; and, a die tooling having a first, generally planar surface secured to said back-up plate, and a second, opposite surface against which metal is formed, said die tooling having at least one bore formed therein which extends from said first surface toward said second surface, said at least one bore being in fluid communication with said air plenum.

10. A die tooling assembly according to claim 9, wherein said back-up plate defines a plurality of concentric annular grooves, at least one of said grooves receiving a seal while another of said grooves serves as said air plenum.

11. A method for monitoring a pressing operation to determine whether a die tooling has shifted or fractured, comprising the steps of:

providing a die tooling having an air passage formed therein;

pressurizing the air passage to a first predetermined air pressure level;

sensing a pressure within the air passage;

turning the press off when the sensed pressure drops below a second predetermined value.

12. The method according to claim 11, wherein the press is turned off immediately when the sensed pressure drops below the second predetermined value.

13. The method according to claim 11, wherein the press is turned off at the completion of a cycle when the sensed pressure drops below the second predetermined value.

* * * * *